US008851532B2

(12) United States Patent
Geringer et al.

(10) Patent No.: US 8,851,532 B2
(45) Date of Patent: Oct. 7, 2014

(54) ELECTRIC STRIKE

(75) Inventors: Arthur V. Geringer, Oak Park, CA (US); David A. Geringer, Camarillo, CA (US); Richard Geringer, Moorpark, CA (US)

(73) Assignee: 1 Adolfo, LLC, Camarillo, CA (US)

( * ) Notice: Subject to any disclaimer, the term of this patent is extended or adjusted under 35 U.S.C. 154(b) by 524 days.

(21) Appl. No.: 12/844,671

(22) Filed: Jul. 27, 2010

(65) Prior Publication Data

US 2011/0181060 A1 Jul. 28, 2011

Related U.S. Application Data

(60) Provisional application No. 61/228,830, filed on Jul. 27, 2009.

(51) Int. Cl.

| | |
|---|---|
| ***E05C 3/06*** | (2006.01) |
| *E05B 47/00* | (2006.01) |
| *E05B 17/00* | (2006.01) |

(52) U.S. Cl.

CPC ..... *E05B 47/0047* (2013.01); *E05B 2047/0073* (2013.01); *E05B 2047/0076* (2013.01); *E05B 17/007* (2013.01)

USPC ..... 292/200

(58) Field of Classification Search

CPC ..... E05B 65/006; E05B 81/14; E05B 85/045; E05B 15/0205

USPC ..... 292/1, 201, 340, 341.15, 341.16, 292/341.11–341.19

See application file for complete search history.

(56) References Cited

U.S. PATENT DOCUMENTS

| | | | | | |
|---|---|---|---|---|---|
| 1,471,455 | A | * | 10/1923 | Ernst | 292/341.16 |
| 1,793,115 | A | * | 2/1931 | Model | 292/341.18 |
| 2,193,488 | A | * | 3/1940 | Morley et al. | 292/168 |
| 3,638,984 | A | * | 2/1972 | Davidson | 292/341.16 |
| 3,861,727 | A | * | 1/1975 | Froerup et al. | 292/341.16 |
| 4,613,176 | A | * | 9/1986 | Kelly | 292/201 |
| 4,917,425 | A | * | 4/1990 | Logas | 292/341.16 |
| 4,986,584 | A | * | 1/1991 | Logas | 292/341.16 |
| 5,681,070 | A | * | 10/1997 | Williams et al. | 292/341.16 |
| 5,735,559 | A | * | 4/1998 | Frolov | 292/341.16 |
| 6,299,225 | B1 | * | 10/2001 | Chang | 292/341.16 |
| 6,595,563 | B2 | * | 7/2003 | Kiernan | 292/341.16 |
| 6,634,685 | B2 | * | 10/2003 | Herron et al. | 292/341.16 |
| 6,746,059 | B2 | * | 6/2004 | Thomas | 292/228 |

(Continued)

*Primary Examiner* — Kristina Fulton
*Assistant Examiner* — Nathan Cumar
(74) *Attorney, Agent, or Firm* — Koppel, Patrick, Heybl & Philpott

(57) ABSTRACT

An electric strike according to the present invention comprises a housing, and an actuator mounted to the housing to switch operation of said strike between open and locked modes. In changing the modes the actuator provides lateral motion and a blocking element is included that is also mounted to the housing and cooperates with the actuator. The actuator's lateral motion causes rotational movement in the blocking element to switch between said open and locked modes. Different embodiments of the present invention can operate as dual mode electric strikes wherein the actuator is movable between fail-safe and fail-secure positions, and can include switches and paddles to monitor the position or condition of certain mechanisms in or working with the strikes. In some embodiments the blocking element can be rotatably mounted to the housing at a plurality of rotation mounting points and can comprise a plurality of blocking surfaces. In other embodiments, at least one of the one or more blocking surfaces having a pre-load movement mechanism to reduce friction with the keeper.

22 Claims, 12 Drawing Sheets

(56) References Cited

U.S. PATENT DOCUMENTS

| | | | | |
|---|---|---|---|---|
| 6,874,830 | B2 * | 4/2005 | Bashford | 292/341.16 |
| 6,935,663 | B2 * | 8/2005 | Schildwachter et al. | 292/341.16 |
| 7,144,053 | B2 * | 12/2006 | Bashford | 292/341.16 |
| 7,438,335 | B1 * | 10/2008 | Uyeda | 292/341.16 |
| 7,472,934 | B2 * | 1/2009 | Burke et al. | 292/341.16 |
| 7,540,542 | B2 * | 6/2009 | Geringer et al. | 292/341.16 |
| 2006/0087125 | A1 * | 4/2006 | Moon et al. | 292/32 |
| 2006/0202490 | A1 * | 9/2006 | Burke et al. | 292/341.16 |
| 2008/0224481 | A1 * | 9/2008 | Geringer et al. | 292/201 |
| 2010/0127518 | A1 * | 5/2010 | Huang | 292/341.16 |

* cited by examiner

FIG. 1
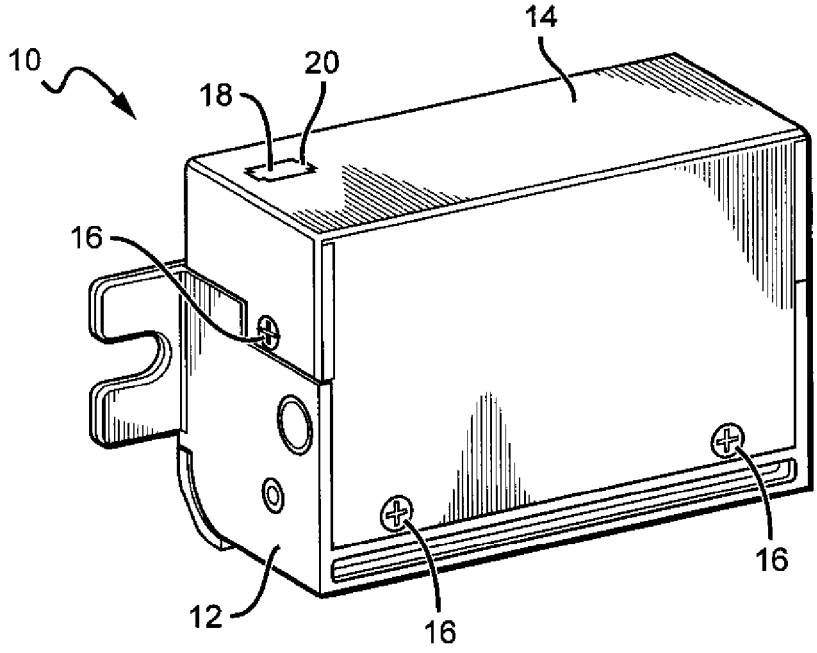
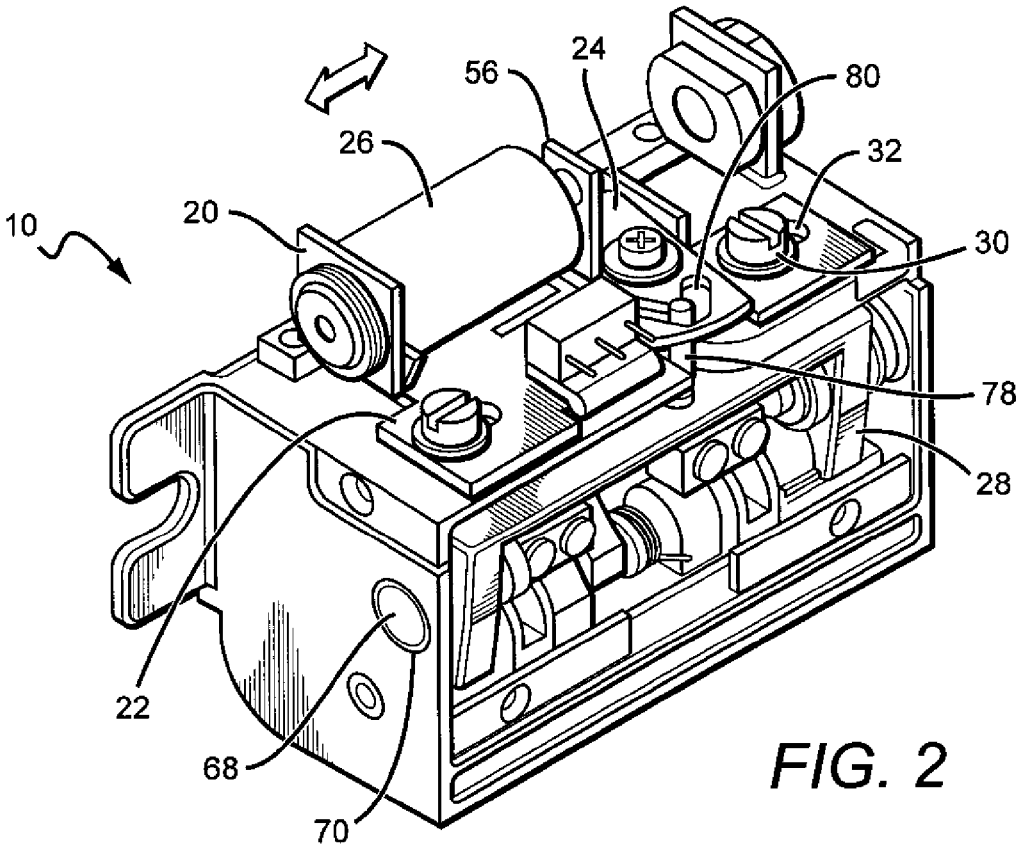
FIG. 2

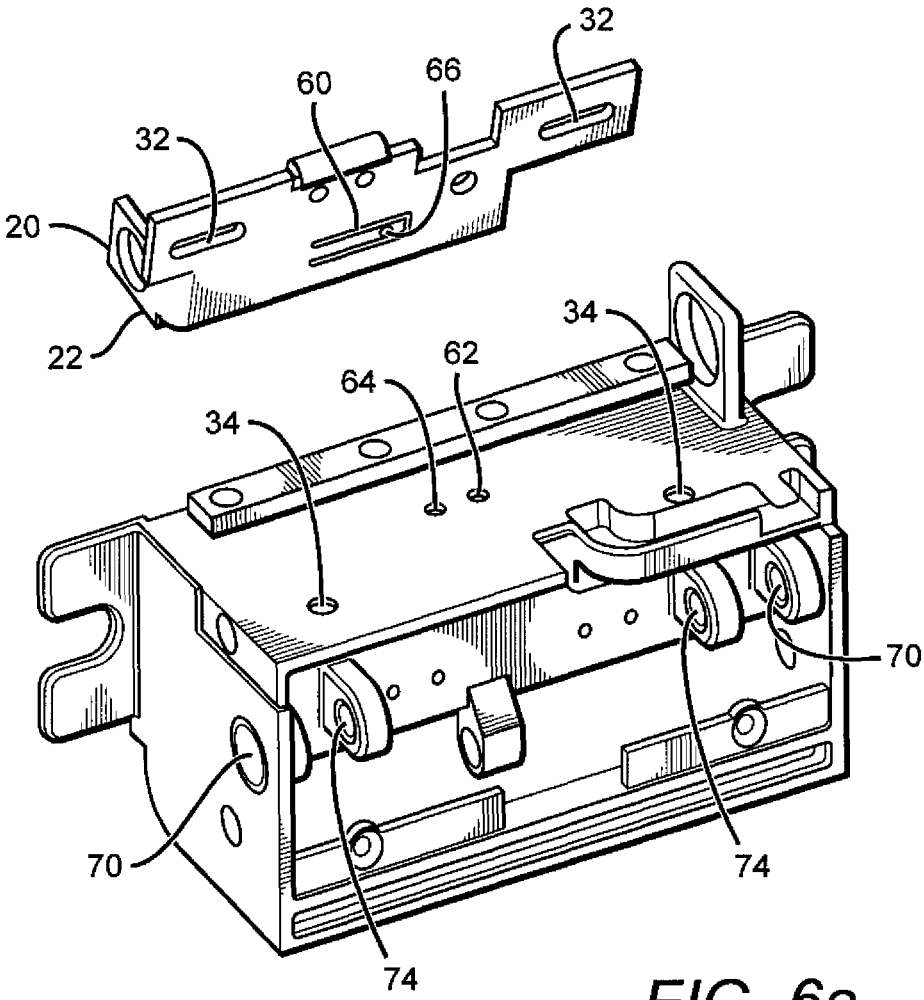
FIG. 6a
FIG. 6b
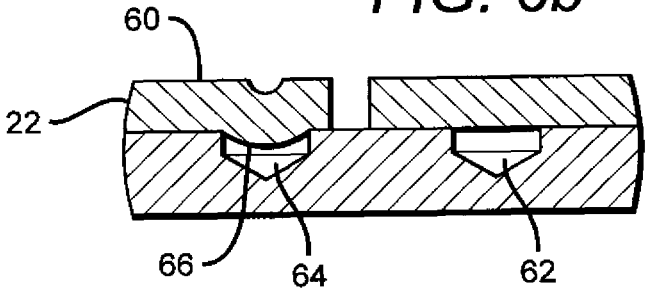

FIG. 10
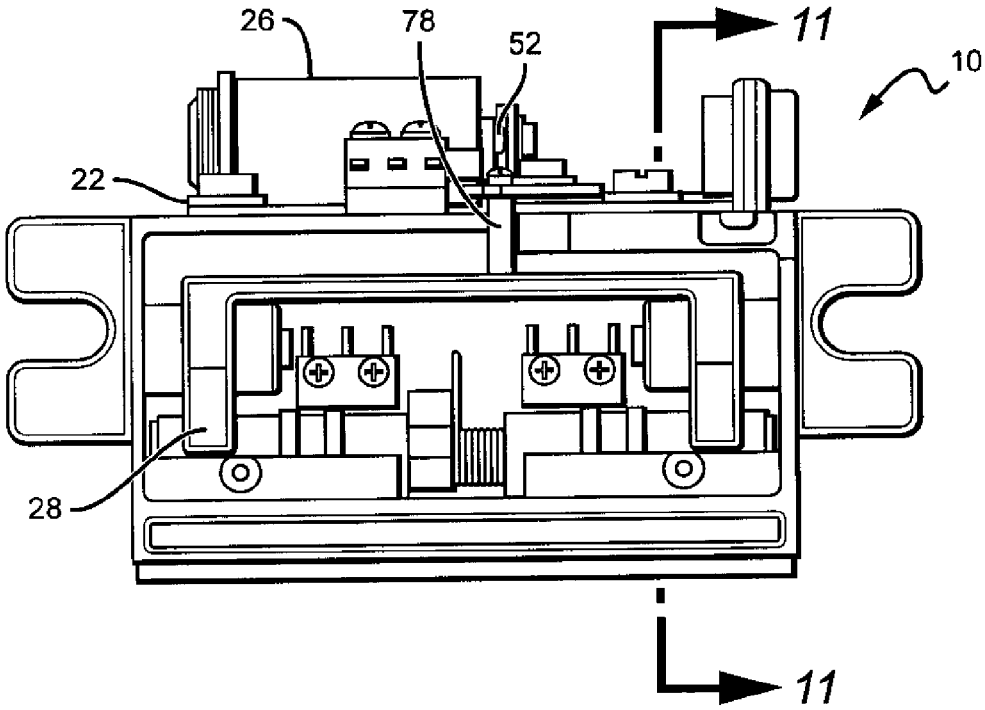
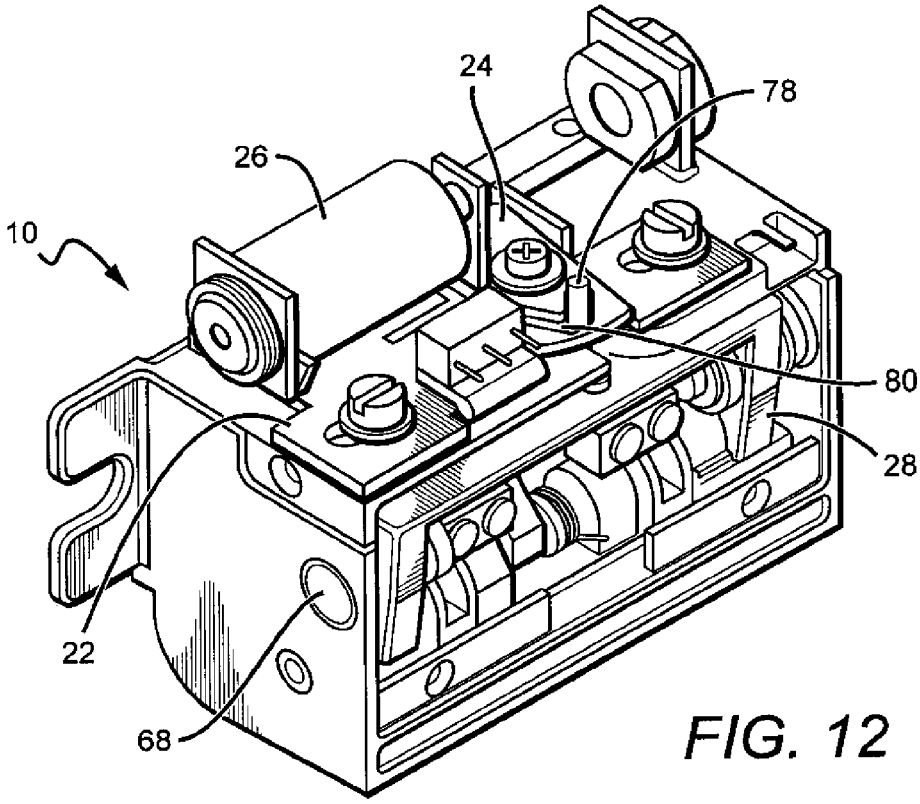
FIG. 12

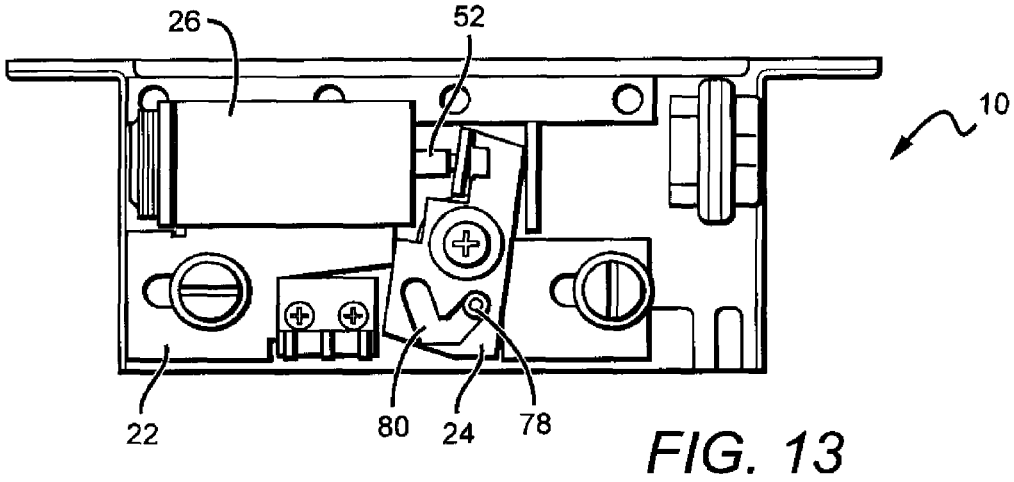
FIG. 13
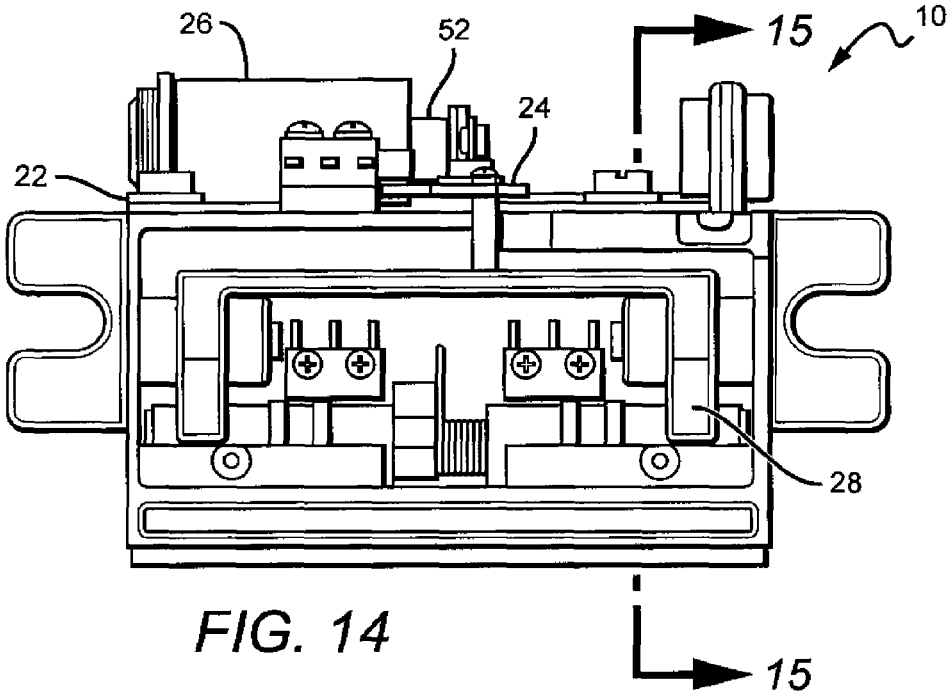
FIG. 14
FIG. 15
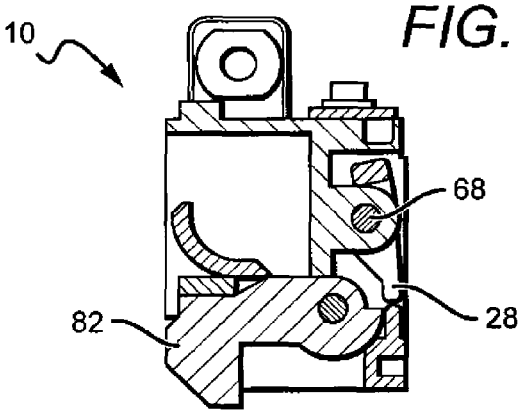

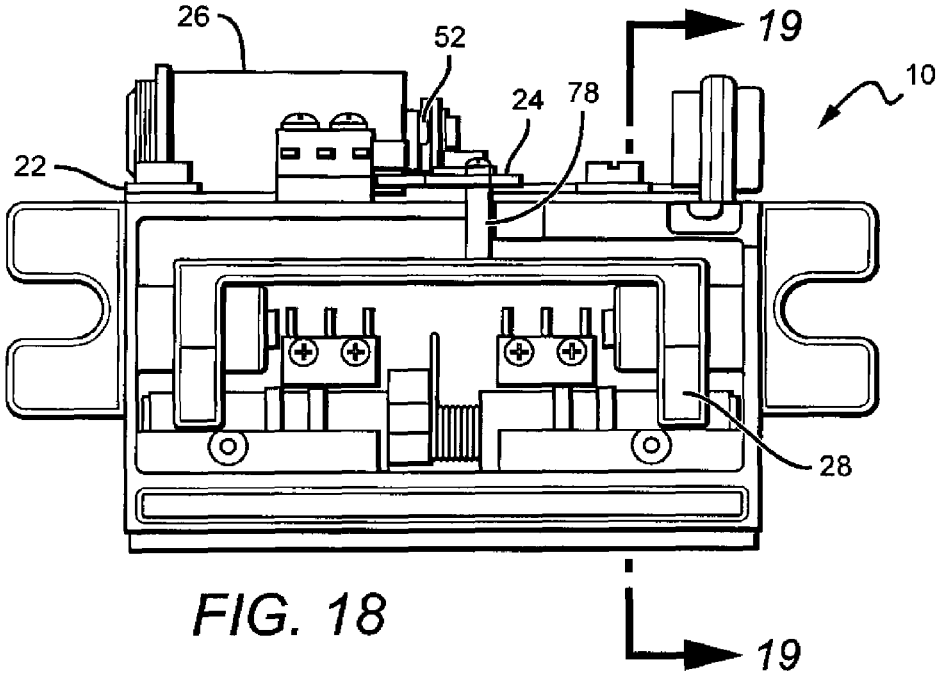
FIG. 18
FIG. 20
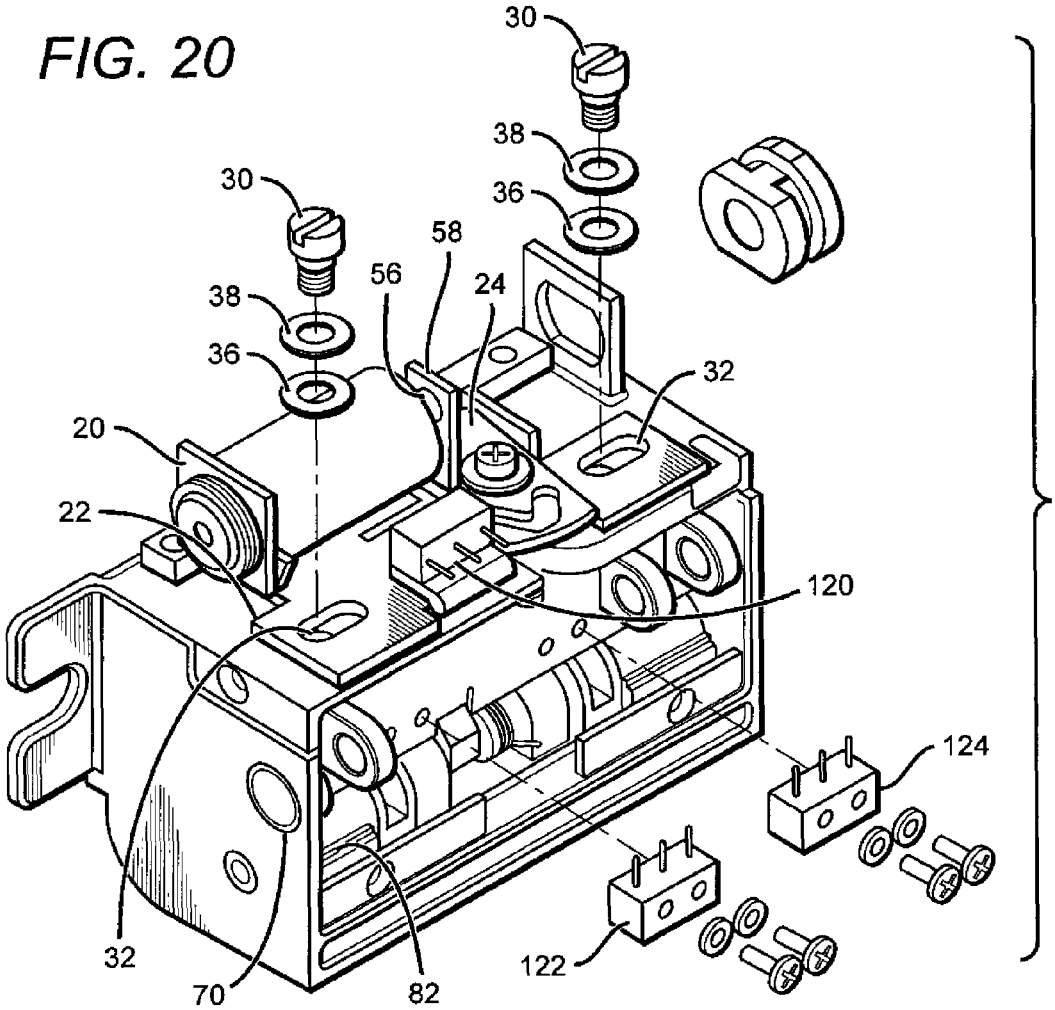

ELECTRIC STRIKE

This application claims the benefit U.S. Provisional Patent Application Ser. No. 61/228,830 to Geringer et al., entitled "Electric Strike", and filed on Jul. 27, 2009.

BACKGROUND OF THE INVENTION

1. Field of the Invention

This invention relates to strikes for doors, and in particular for electric strikes that are operable and can be changed to operate in fail-safe and fail-secure modes.

2. Description of the Related Art

Door locking mechanisms and security doors to prevent theft or vandalism have evolved over the years from simple doors with heavy duty locks to more sophisticated egress and access control devices. Hardware and systems for limiting and controlling egress and access through doors are generally utilized for theft-prevention or to establish a secured area into which (or from which) entry is limited. For example, retail stores use such secured doors in certain departments (such as, for example, the automotive department) which may not always be manned to prevent thieves from escaping through the door with valuable merchandise. In addition, industrial companies also use such secured exit doors to prevent pilferage of valuable equipment and merchandise.

Electric strikes are a class of door mechanisms that have been developed to control access to buildings or areas. An actuator (e.g. an electrically driven motor or solenoid) is used to move a blocking element to block or release a keeper to either prevent or allow release of a door's latch bolt. This keeps the door latched and in the locked position or allows the door to be opened. Typically, electric strikes have two modes, namely a "fail-secure" mode (where the door is locked with the power removed, i.e. the actuation means must be triggered to allow the door to be opened), and a "fail-safe" mode (where the door is unlocked with the power removed, i.e. the actuation means must be triggered to prevent the door from being opened). Some strikes on the market have only one-mode capability, while others are dual mode allowing the installer to select which mode is desired at the time of installation.

Different dual-mode electric strikes have been developed such as the commercially available GEM model GK-300 and ROFU 2400 series models. Each model has a solenoid mounted on a holder, which is movable within the strike housing. A blocking element is directly attached to the plunger of the solenoid, to block movement of the keeper when the strike is in its locked position. A first screw, reachable from outside the housing, cooperates with a slot or elongated opening in the housing, to define the path along which the holder is movable. The strike can be changed between fail-safe to fail-secure modes by loosening the first screw and moving it to one of the ends in the slot. The first screw can then be tightened to fasten the holder to the housing, i.e. the holder cannot move. First and second holes are arranged on the housing, to alternately align with a second screw, also reachable from outside the housing. At each end position along the holder path of movement one of a threaded third or fourth holes, both arranged on the holder, is aligned with either the first hole or the second hole, and the second screw can be inserted into the appropriate first or second hole and screwed into the visible third or fourth hole. This second screw arrangement helps hold the holder in its selected one of the end positions. The installer can configure the GEM and ROFU strikes in either the fail-safe or fail-secure mode by positioning the screw at one of the ends of the slot, and the second screw helps hold the strike in that mode. A similar arrangement is also reflected in U.S. Pat. No. 6,299,225 to Chang.

U.S. Pat. Nos. 6,874,830 and 7,144,053 to Bashford describe an electric strike having a housing, a keeper pivotally arranged in the housing, and a holder slidably arranged in the housing. The electric strike also includes a blocking element slidably arranged in the holder. The blocking element is configured to selectively prevent a rotation of the keeper and allow the rotation of the keeper. The electric strike also includes a two-position mode selector operable from outside the housing, and the selector is configured to selectively move the holder from a first position to a second position and vice versa. The electric strike also includes an actuator configured to selectively move the blocking element. Specifically, when the holder is in the first position, the blocking member allows the rotation of the keeper when the actuator is energized and prevents the rotation of the keeper when the actuator is not energized, and when the holder is in the second position, the blocking member prevents the rotation of the keeper when the actuator is energized and allows the rotation of the keeper when the actuator is not energized.

U.S. Pat. No. 7,540,542 to Geringer et al. describes an electric strike comprising a housing and a keeper pivotally mounted to the housing. A solenoid is arranged internal to the housing and movable between fail-safe and fail-secure positions. A two position mode control slot comprising two counter-bores is included in the housing and a mode control screw is included in the mode control slot. The screw is capable of being tightened in each of the two counter-bore positions in the control slot. The screw is changeable between the two of the positions without removal of the screw. The solenoid is in the fail-safe position when the screw is in one of the two positions and in the fail-secure position when the screw is in the other of the two positions.

SUMMARY OF THE INVENTION

The present invention comprises an improved electric strike to provide efficient, reliable and robust operation. One embodiment of an electric strike according to the present invention comprises a housing, and an actuator mounted to the housing to switch operation of the strike between open and locked modes. In changing the modes the actuator provides lateral motion. A blocking element is also mounted to the housing and cooperates with the actuator. The actuator's lateral motion causes rotational movement in the blocking element to switch between the open and locked modes.

One embodiment of a dual mode electric strike comprises a housing and an actuator mounted to the housing and movable between fail-safe and fail-secure positions. The actuator is also operable to switch between lock and unlock. A keeper is rotationally mounted in the housing and blocked from rotating when in the lock mode, and free to rotate when in the unlocked mode. A first bolt paddle monitors for the presence of a latch bolt and a first switch monitors the location of the keeper.

Another embodiment of a dual mode electric strike comprises a housing and a keeper movably mounted to the housing. A blocking element is rotatably mounted to the housing at a plurality of rotation mounting points with the blocking element rotationally movable between locked and unlocked positions. The blocking element comprises a plurality of blocking surfaces to block movement of the keeper when in a locked rotational position.

Another embodiment of an electric strike according to the present invention comprises a housing and an actuator mounted to the housing to switch operation of the strike between open and locked modes, with the actuator providing lateral motion. A blocking element is mounted to the housing and cooperates with the actuator. The actuator's lateral motion causes movement of the blocking element in a direction different than the actuator lateral motion.

Still another embodiment of an electric strike according to the present invention comprises a housing and a keeper rotationally mounted to the housing. An actuator is mounted to the housing to switch operation of the strike between open and locked modes. A blocking element is mounted to the housing and cooperates with the actuator. The actuator causes movement in the blocking element to switch between open and locked modes, with the blocking element having one or more blocking surfaces to contact and block movement of the keeper when the actuator is in lock mode. At least one of the one or more blocking surfaces have a pre-load movement mechanism to reduce friction with the keeper.

The strikes according to the present invention can comprise many different features as described below. These and other aspects and advantages of the invention will become apparent from the following detailed description and the accompanying drawings which illustrate by way of example the features of the invention.

BRIEF DESCRIPTION OF THE DRAWINGS

FIG. 1 is a perspective view of one embodiment of an electrical strike according to the present invention;

FIG. 2 is a perspective view of the electric strike in FIG. 1 with the cover removed and in the fail-secure mode;

FIG. 6*a* is a partial exploded view of the electric strike in FIG. 2;

FIG. 6*b* is a sectional view of the mode position tray on the housing;

FIG. 10 is a front view of the electric strike in FIG. 8;

FIG. 12 is a perspective view of the electric strike in FIG. 2 in the fail-safe mode;

FIG. 13 is a top view of the electric strike in FIG. 12;

FIG. 14 is a front view of the electric strike in FIG. 12;

FIG. 15 is a side sectional view of the electric strike in FIG. 12;

FIG. 18 is a front view of the electric strike in FIG. 16;

FIG. 20 is a partial exploded view of the electric strike in FIG. 2;

FIG.

DETAILED DESCRIPTION OF THE INVENTION

Figure 3:
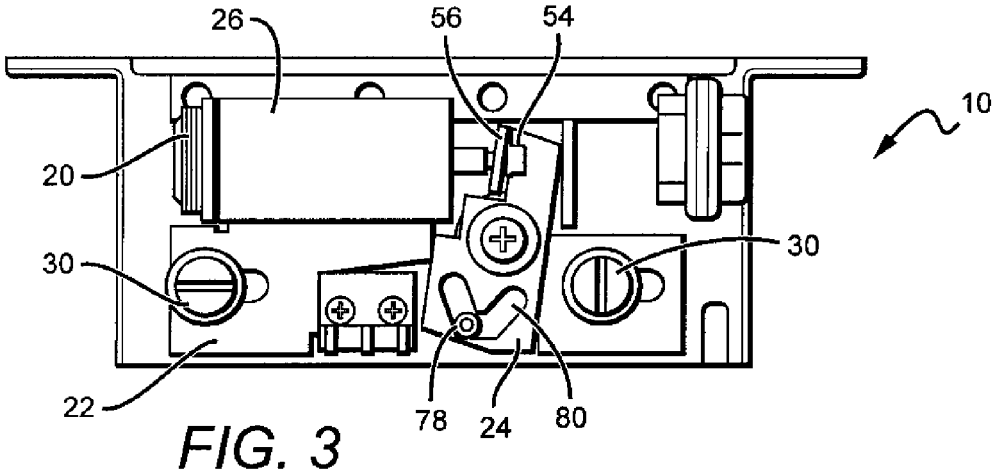
FIG. 3 is a top view of the electric strike in FIG. 2.
Figure 4:
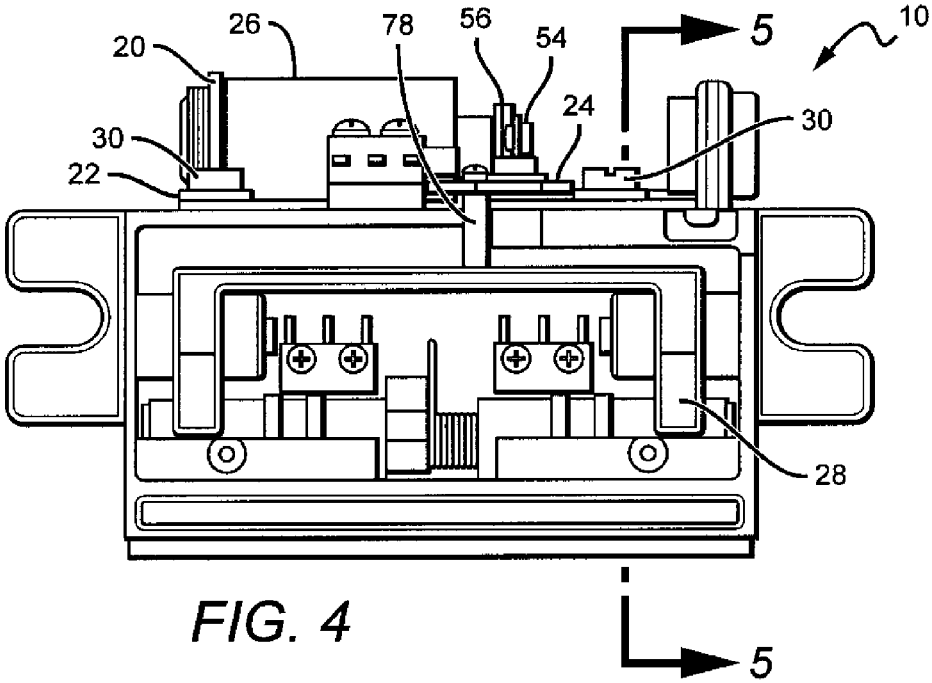
FIG. 4 is a front view of the electric strike in FIG. 2.

The present invention provides an improved dual mode electric strike that can be changed in the field to be operable in both the fail-safe and fail-secure modes. In some embodiments according to the present invention, the mode is changed by a simple manipulation of the internal component of the strike through a window in the housing or cover of the strike. In one embodiment this manipulation comprises sliding a mode position tray between two positions corresponding to the fail-safe and fail secure modes. The tray also comprises an improved arrangement for imparting a mode change on the stop lever or blocking element ("blocking element") that blocks motion of the keeper to prevent the door from opening. The improved arrangement efficiently moves the position of the blocking element in response to movement of the tray to the other one of the positions, or by the solenoid changing from energized to unenergized, or vice versa. In other embodiment this sliding of the mode position tray can be accomplished by removing a cover of the electric strike and manually sliding the tray or the solenoid on the tray.

Different embodiments according to the present invention can also be arranged to provide heavy duty operation that allows for the keeper to withstand elevated forces. In one embodiment, the blocking element that blocks rotation of the keeper to prevent opening of the door is arranged to move between blocking and unblocking position through rotational movement. That is, the blocking element is such that it can axially pivot or rotate within the electric strike to move between the different modes. In still other embodiments, the blocking element provides two blocking points adjacent to the blocking elements mounting points to the housing. This also allows for the electric strike to withstand elevated forces on the keeper when in the keeper blocking position.

Different embodiments according to the present invention can also comprise additional features to provide for improved operation. Some of these include features that allow for the keeper to open when intended even if the keeper is experiencing a "pre-load" force. In prior electric strikes, this pre-load can result in the keeper not opening when in the open mode. Different electric strikes according to present invention can also comprise adjust plates that can be mounted to the keeper to adjust the size of the strike opening for the lock bolt. In still other embodiments, the electric strike can comprise one or more switches to monitor the location of the various internal moving parts of the strike, to monitor the strikes operation and mode.

The present invention is described herein with reference to certain embodiments, but it is understood that the invention can be embodied in many different forms and should not be construed as limited to the embodiments set forth herein. In particular many the internal components of the electric strikes according to the present invention can be arranged in many different ways and different embodiments can comprise different internal components. The fail-safe/fail-secure mode selector can be arranged in many different ways, different blocking elements can be used, different pre-load features can be used, and different switches in different locations can be used.

It is also understood that when an element or component is referred to as being "on", "connected to" or "coupled to" another element, it can be directly on, connected to or coupled to the other element or intervening elements may also be present. Furthermore, relative terms such as "front", "back", "inner", "outer", "upper", "above", "lower", "beneath", and "below", and similar terms, may be used herein to describe a relationship of one component of element to another. It is understood, however, that these terms are intended to encompass different orientations of the device in addition to the orientation depicted in the figures.

Although the terms first, second, etc. may be used herein to describe various elements or components these elements and components should not be limited by these terms. These terms are only used to distinguish one element or component from another element or component. Thus, a first element or component discussed below could be termed a second element or component without departing from the teachings of the present invention.

Embodiments of the invention are described herein with reference to certain illustrations that are schematic illustrations of idealized embodiments of the invention. As such, variations from the shapes of the illustrations as a result, for example, of manufacturing techniques and/or tolerances are expected. Embodiments of the invention should not be construed as limited to the particular shapes of the elements or components illustrated herein but are to include deviations in shapes that result, for example, from manufacturing. Thus, the regions illustrated in the figures are schematic in nature and their shapes are not intended to illustrate the precise shape of an element or component and are not intended to limit the scope of the invention.

FIGS. 1-5 show one embodiment of an electric strike 10 according to the present invention. Referring first to FIG. 1, a strike 10 is shown that comprises a housing 12 holding the strike's internal components. Cover 14 is mounted to the housing 12 to cover some of the strike's internal components, and the cover 14 can be removed from the housing 12 by removing housing screws 16. In the embodiment shown, the cover 14 comprises a mode control access window 18 through which the internal components of the strike 10 can be manipulated to change the mode of the strike between fail-safe and fail-secure. In this embodiment a tray tab 20 is accessible through the window and movement of the tab between ends of the window 18 changes the mode of the strike between the different modes. It is understood that different mechanisms can be provided to change between the modes beyond the window tab arrangement described herein.

Referring now to FIGS. 2-5, the strike 10 is shown with the cover 14 removed to reveal the strike's internal components. The strike 10 can comprise a mode position tray 22, a solenoid lever 24, and solenoid 26 that cooperate to control the position of the blocking element depending on the mode of the electric strike. Referring to FIGS. 6*a*, 6*b*, 7, 20 and 21 in conjunction with FIG. 2-5, the mode position tray 22 is mounted to the housing 12 by tray screws 30 that pass through tray slots 32 and turn into tray holes 34 (best shown in FIG. 6*a*) in the housing 12. In one embodiment, the tray screws 30 can comprise shoulder screws with disc spring 36 and flat washer 38 (best shown in FIG. 20) held between the tray 22 and the head of the screws 30. This arrangement allows for lateral movement of the tray 22 when changing modes, while at the same time holding the tray in place at the selected mode selection position.

Figure 21:
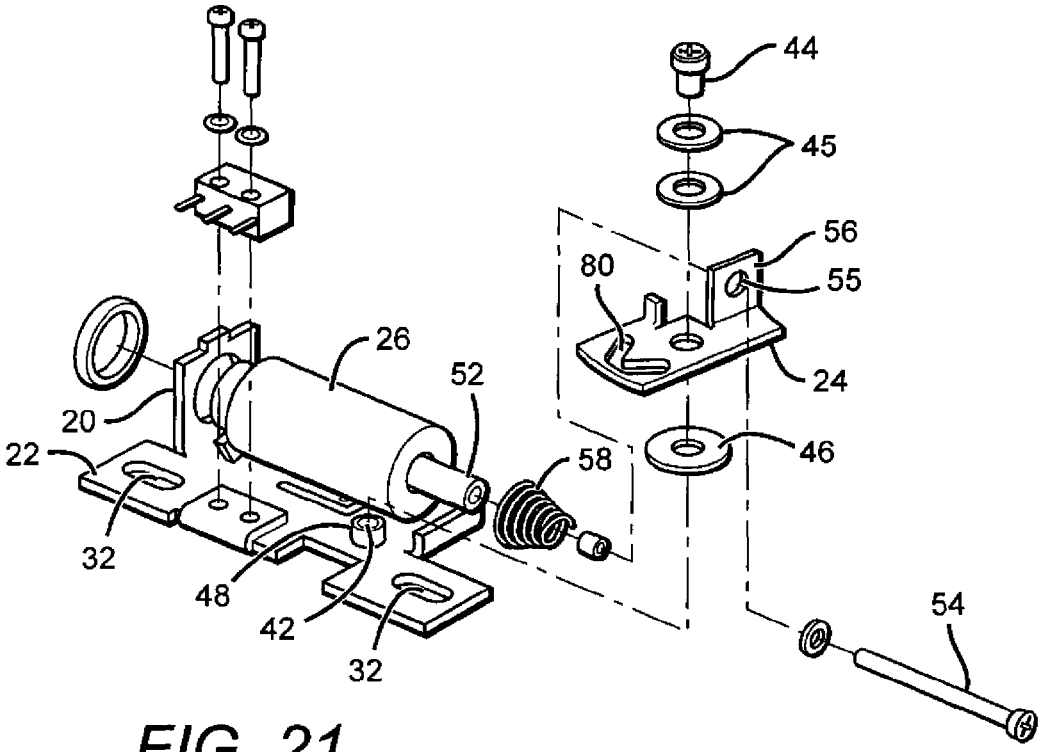
FIG. 21 is a partial exploded view of the solenoid and mode position tray for the electric strike in FIG. 2.

As best shown in FIG. 21, the solenoid lever 24 is mounted to the tray 22 by a lever screw 44 that is tightened in a tray hole 42 with two top washers 45 between the head of screw 44 and the lever 24. A bottom washer 46 is also included between the lever 24 and the tray 22. The tray hole 42 has a sleeve 48 extending up from the tray 22 with the sleeve 48 providing a surface that allows for the lever 24 to rotate around the sleeve 48.

The solenoid 26 is mounted to the tray 22 at the tray tab 20. The elements and operation of solenoids is generally known in the art and is not discussed in detail herein. A plunger 52 (best shown in FIG. 21) is mounted within the solenoid 26 and extends from the solenoid 26 toward the lever 24. The lever 24 is mounted to the solenoid plunger 52 by plunger screw 54 that passes through a hole 55 in the lever tab 56 and is threaded into the plunger 52. A plunger spring 58 is included on the plunger 52 to bias the plunger to extend from the solenoid 26 when the solenoid 26 is not energized.

With this arrangement, the extension of retraction of the plunger 52 in the solenoid 26 causes rotation of the lever 24 about the sleeve 48. This causes rotation of the lever 24 relative to the tray 22. This arrangement also causes sliding of the lever 24 with the tray 22, as the tray 22 is moved between the fail-safe and fail-secure positions.

In different embodiments according to the present invention, the tray 22 can be held in the fail-safe and fail-secure positions using many different holding mechanisms. Referring now to FIGS. 6*a* and 6*b*, the embodiment shown utilizes a spring lever arm 60 that cooperates with fail-secure detent/hole 62 and fail-safe detent/hole 64, with the spring lever arm 60 having a button 66 arranged in the particular detent/hole depending on the desired mode. In the fail-safe mode, the button 66 is in the fail-safe detent/hole 64, and when the mode is changed to fail-secure, a lateral movement on the tray is imparted by moving the tray tab 20 in the access window 18 as described above. This motion causes the spring lever arm 60 to flex up as the button 66 moves out of the fail-safe detent/hole 64. This allows the button 66 to slide along the surface of the tray 22 with arm 60 remaining flexed. When the button is over the fail-secure detent/hole 62, the arm 60 flexes back down so that the button is in the fail-secure detent/hole. A movement of the tray 22 in the opposite direction causes a similar action to move the button 66 back in the fail-safe detent/hole 64. When the button 66 is in a particular one of the detent/holes it provides a holding force to keep the tray 22 in that position until change be the user through sliding of the tray 22.

In strikes according to the present invention, the blocking element 28 is arranged to cooperate with the mode selector to operate the strike in fail-safe or fail-secure modes. In the embodiment shown, the blocking element 28 is mounted within the housing 12 so that it can rotate within the housing 12. Two retaining pins 68 (best shown in FIG. 7) pass through first pin holes 70 in the housing 12 and through second pin holes 72 in the blocking element 28. Each of the pins 68 then passes through a pin tab hole 74, with each of the pins 68 mounted in place with a retaining ring 75 mounted to the groove in its respective one of the pins 68. This arrangement allows for rotation of the blocking element about the pins 68, while also providing a robust mounting point to withstand elevated forces on the blocking elements 28.

The blocking element 28 has a blocking element finger 78 that is inserted in the slot 80 in the lever 24. The slot 80 can have many different shapes and sizes and can be arranged in many different ways. In most embodiments the slot has multi-angular sections and in some embodiments it can be V or U-shaped. It is understood, however, that the slot can be many other shapes. The slot 80 cooperates with the finger 78 such that movement of the lever 24 relative to the finger 78 causes the finger 78 to change locations within the slot. The multi-angular sections of the slot 80 cause rotation of the blocking element 28 about the retaining pins 68. For example, when the finger 78 moves from the base of the slot 80 to the end of one of the legs in the slot, the blocking element 28 rotates about the pins 68. This movement of the finger 78 in the slot can be caused be sliding the tray 22 or by rotation of the lever 24 through action of the solenoid 26.

Figure 5:
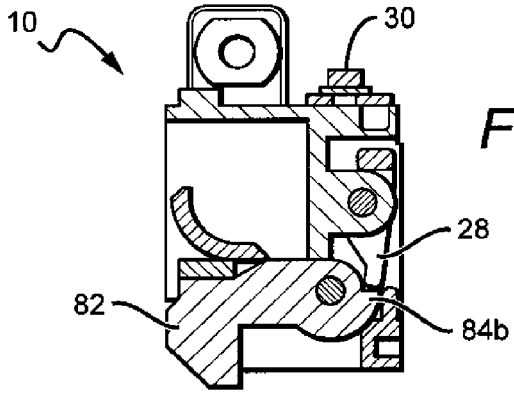
FIG. 5 is a side sectional view of the electric strike in FIG. 2.
Figure 7:
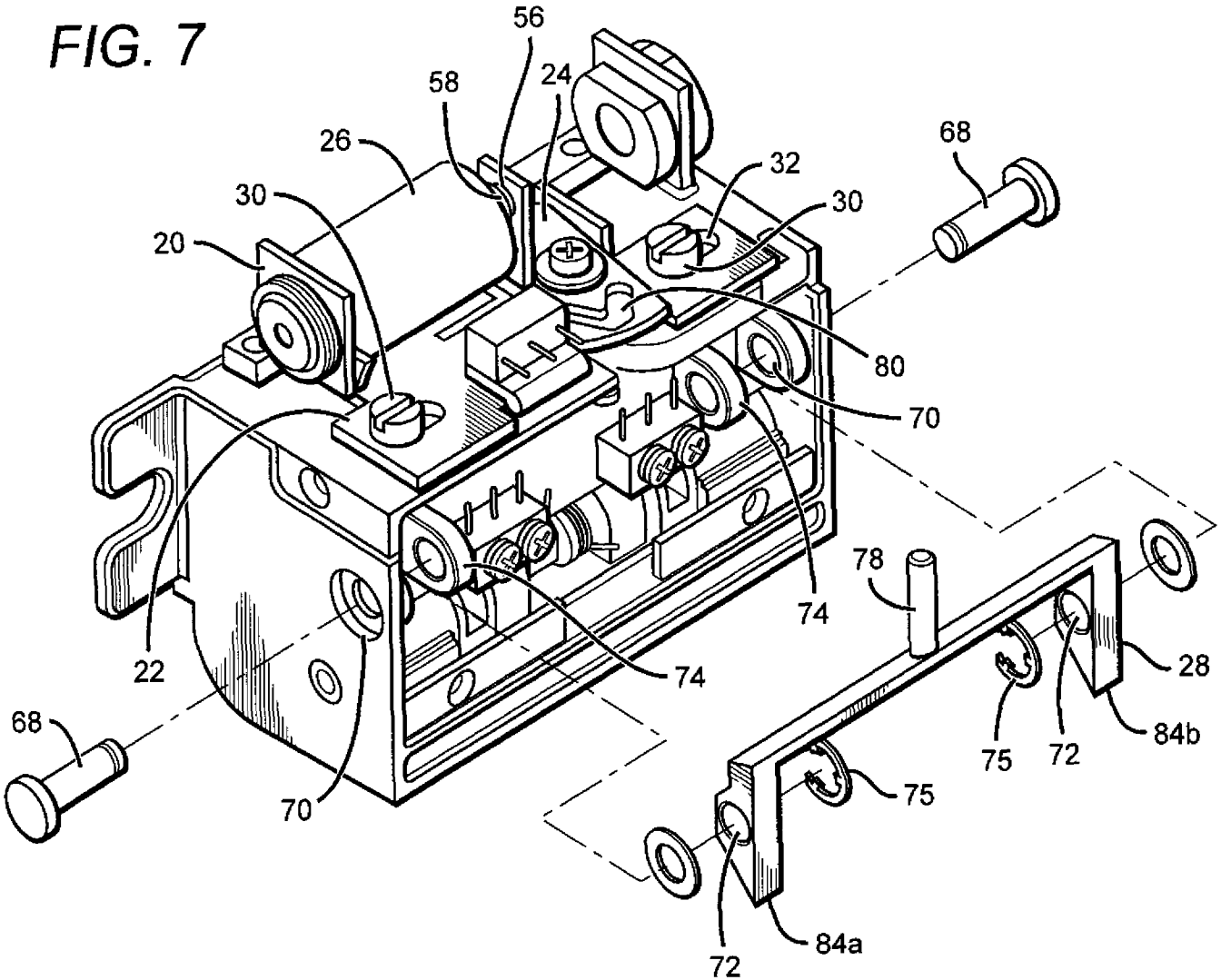
FIG. 7 is a partial exploded view of the electric strike in FIG. 2.
Figure 8:
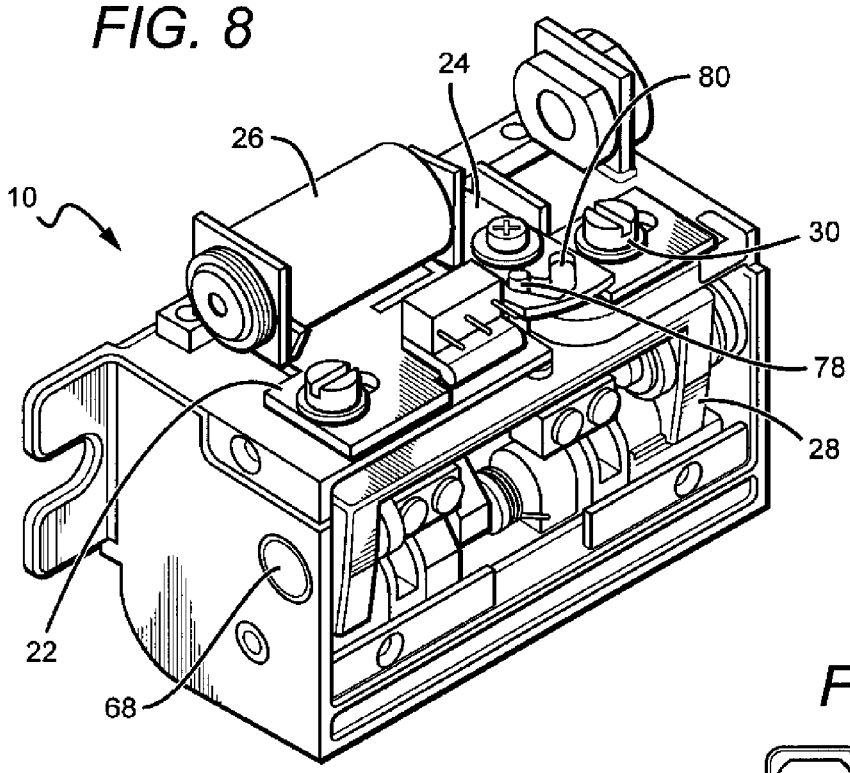
FIG. 8 is a perspective view of the electric strike in FIG. 2 with the solenoid energized.

Referring again to FIGS. 2-5, the strike 10 is shown with the tray 22 in the fail-secure location with the button 66 in the fail-secure detent/hole as described above. In this arrangement the plunger 52 is extended by the plunger spring (not shown). This in turn moves finger 78 to the base of the Slot 80, which in turn rotates the blocking element 28 to a position where it blocks rotation of the strike's keeper 82 as best shown in FIG. 5. This is typically the position of the strike components when the strike 10 is in the fail-secure mode and the strike has failed or power is lost.

Figure 11:
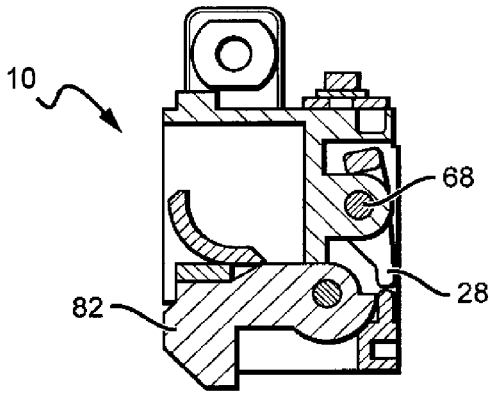
FIG. 11 is side sectional view of the electric strike in FIG. 8.
Figure 9:
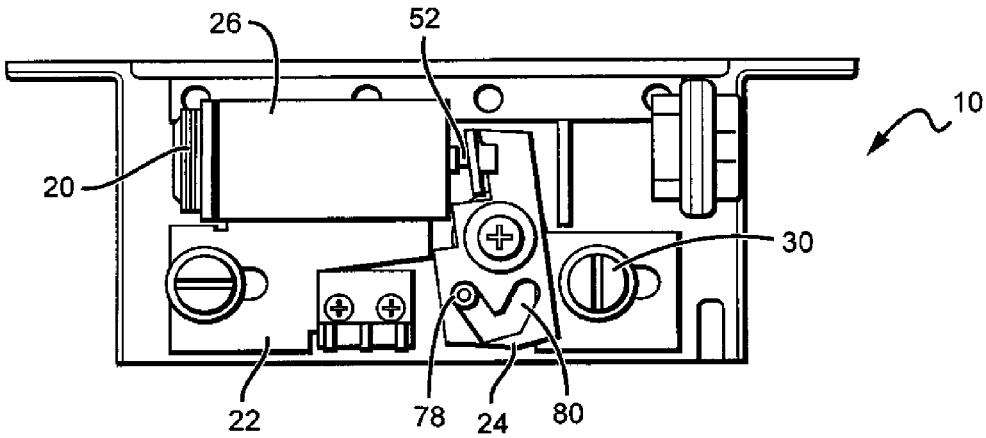
FIG. 9 is a top view of the electric strike in FIG. 8.
Figure 16:
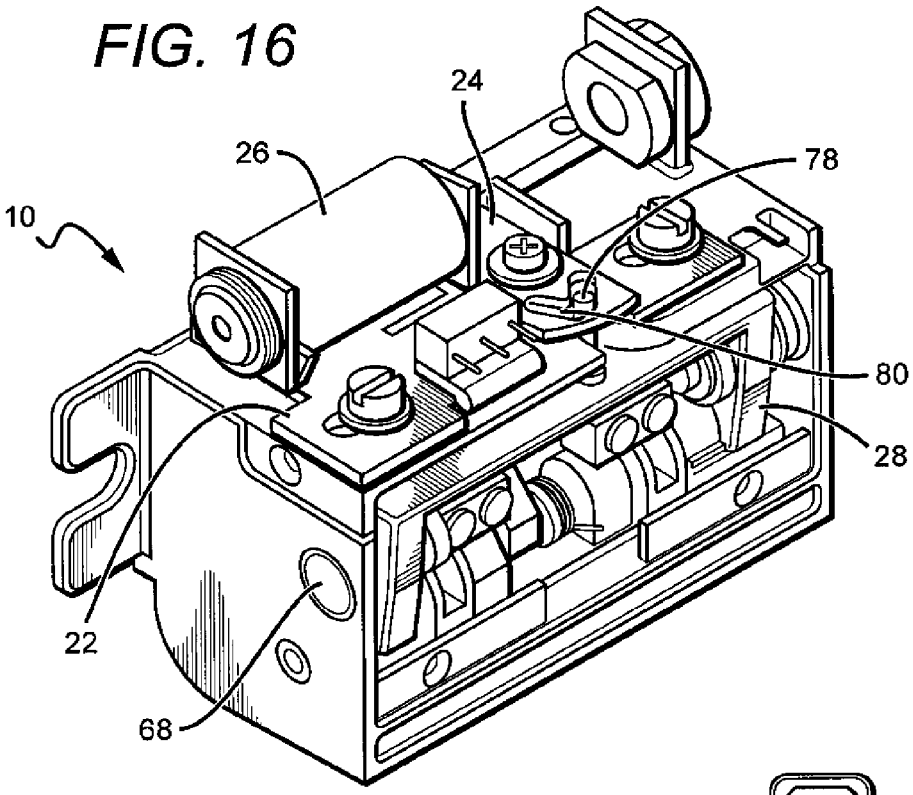
FIG. 16 is a perspective view of the electric strike in FIG. 12 with the solenoid energized.
Figure 19:
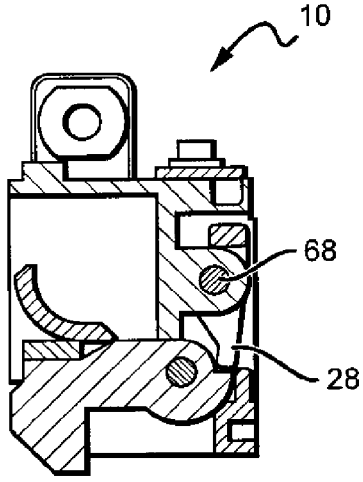
FIG. 19 is a side sectional view of the electric strike in FIG. 16.
Figure 17:
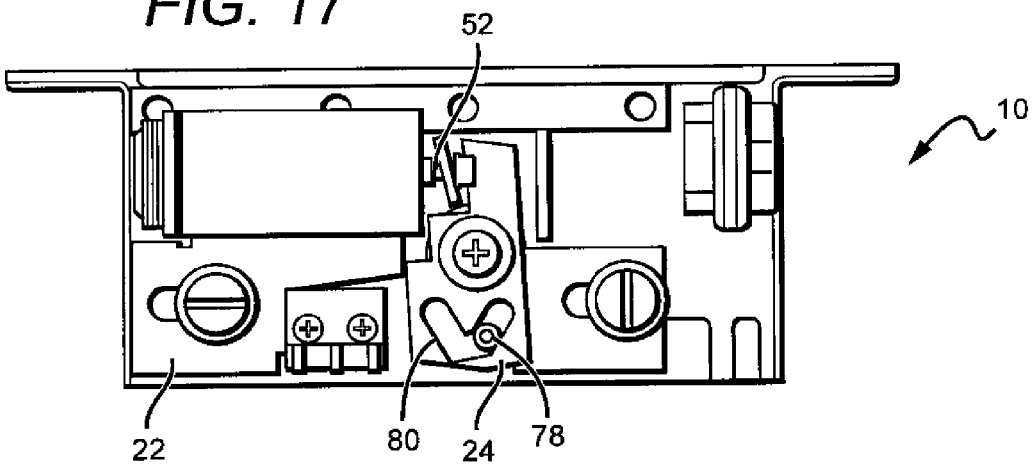
FIG. 17 is a top view of the electric strike in FIG. 16.

FIGS. 8-11 show the strike 10 again in the fail-secure mode, but with the solenoid 26 energized. This causes retraction of the plunger 52 into the solenoid 26, which causes rotation of the lever 24 about the sleeve 48 (shown in FIG. 21) on the tray 22. This in turn causes the blocking element finger 78 to change position within the slot 80 such that it is now at or near the end of a leg of the slot 80. This in turn causes the blocking element 28 to rotate about retaining pins 68. As best shown in FIG. 11 this rotates the blocking element 28 to a position where it does not block rotation of the keeper 82. This is typically the position of the strikes components when the strike allows the latch bolt to be removed from the strike so that the door can be opened.

FIGS. 12-14 show the strike 10 in a fail-safe mode with the tray 22 arranged with the button 66 in the fail-safe detent 64 (shown in FIGS. 6*a* and 6*b*). In this arrangement, the solenoid 26 is unenergized with the plunger 52 extended from the solenoid 26 by the plunger spring (not shown). This causes the lever 24 to rotate about the sleeve 48 (shown in FIG. 21) on the tray 22 so that the blocking element finger 78 moves to one of the fingers of the slot 80. This causes the blocking element 28 to rotate about the retaining pins 68 such that the blocking element 28 does not block rotation of the keeper (as shown in FIG. 15). This arrangement of the strike's internal components allows latch bolt of the door to move out of the strike 10 with rotation of the keeper 14, which allows the door to open. This opening of the door when the solenoid is unenergized reflects the fail-safe operation of the strike, such as through failure or loss of power. This opening can also be allowed when the solenoid 26 is purposefully placed in an unenergized state through external controls.

FIGS. 16-19 show the strike 10 in the fail-safe as in FIGS. 12-14, but with the solenoid 26 energized. This causes the plunger 52 to be retracted into the solenoid 26, which in turn causes the lever 24 to rotate so that the blocking element finger 78 is at the base of the slot. This in turn causes rotation of the blocking element 28 so that it blocks rotation of the keeper 82 (best shown in FIG. 19). This causes the keeper 82 to block any latch bolt with the strike 10 from being removed from the strike 10. In this mode the door is blocked from being opened by rotation of the keeper 82.

As is apparent from the description above and the accompanying figures, the present invention proves a unique mechanism that transfers the lateral motion caused by extension and retraction of the solenoid plunger 52 and sliding of the tray 22 into rotational motion of the blocking element 28. That is, the unique combination of tray 22, lever 24, solenoid 26 and slot 80 translates the lateral motion of the tray 24 and plunger 52 into rotation motion of the blocking element 28. It accomplishes this in both fail-safe and fail-secure modes.

It is understood that many different mechanisms and arrangements can be used to translate this motion in strikes according to the present invention. Some of these include, but are not limited to, cams, gears, pulleys, etc., and the mechanisms can comprise any combination of the devices described herein. It is also understood that different embodiments need not translate lateral movement to rotation movement, but can translate the lateral movement of the solenoid plunger into many different directions other than in the same direction as the plunder.

The blocking element 28 also provides the advantage of two blocking surfaces 84*a*, 84*b* (best shown in FIG. 7) that contact the keeper 82 when the blocking element 28 is in the position to block the keeper 82. By having two blocking surfaces 84*a* and 84*b* the blocking element 28 can withstand greater forces from the keeper 82. The surfaces 84*a*, 84*b* can also be efficiently moved out of contact with the keeper 82 by minimal rotation of the blocking element about the retaining pins 68 as described above. This combination provides for efficient and robust blocking of the keeper along with efficient changes between blocking and unblocking of the keeper 82. The blocking force of the blocking element 28 is made even more robust by each of the retaining pins 68 being arranged in first and second pin holes 70, 74. The use of two pin holes provides a further increase in the blocking force of the blocking element 28.

It is understood that the blocking element have only one blocking surface or can have more than two, and can be mounted in or to the housing using many different arrangements. For example, the blocking element can be mounted to the housing using a single pin that runs between the first and second pin holes. Another example can comprise a single mounting point that can either be at the end of the blocking element or at a location off the end, such as near the middle of the blocking element. Those skilled in the art would be aware of other alternative arrangements and these are only a few of the arrangements that can be used in strikes according to the present invention.

The electric strike 10 is described above with reference to changing modes by manipulating the strike's internal components through the mode control access window 18. It is understood, however, that the strike's internal components can be manipulated using many different methods and arrangements. Some embodiments can be provided without an access window and the internal component of the strike can be manipulated after removal of the strike cover. In other embodiments, the strike cover can be partially removed to access the internal components. For example, the strike cover can have a hinge along one of its surface or edges that allow for all or part of the cover to rotate away from the strike about the hinge to reveal the strike's internal components. Once the change is made between fail-safe and fail-secure modes, the cover can be returned to its position on the strike. The cover can then be held in place by tabs or screws. In still other embodiments, levers, knobs, handles, switches, screws, bolts or rivets can be used to manipulate the strikes internal components either through the cover or after removal of the cover.

The present invention also provides other features that allow for efficient operation under different circumstances. In most cases strikes can efficiently and reliably change modes from blocking the keeper to unblocking the keeper. This reliability, however, can be reduced in some strikes when the keeper experiences pre-loading in the form of an opening force being applied to the door and the keeper. This pre-loading can cause an increased friction between the contacting surfaces of the blocking element and keeper. This in turn can result in hang-up of the blocking element on the keeper, which can prevent it from reliably changing to the unblocking position.

Figure 22:
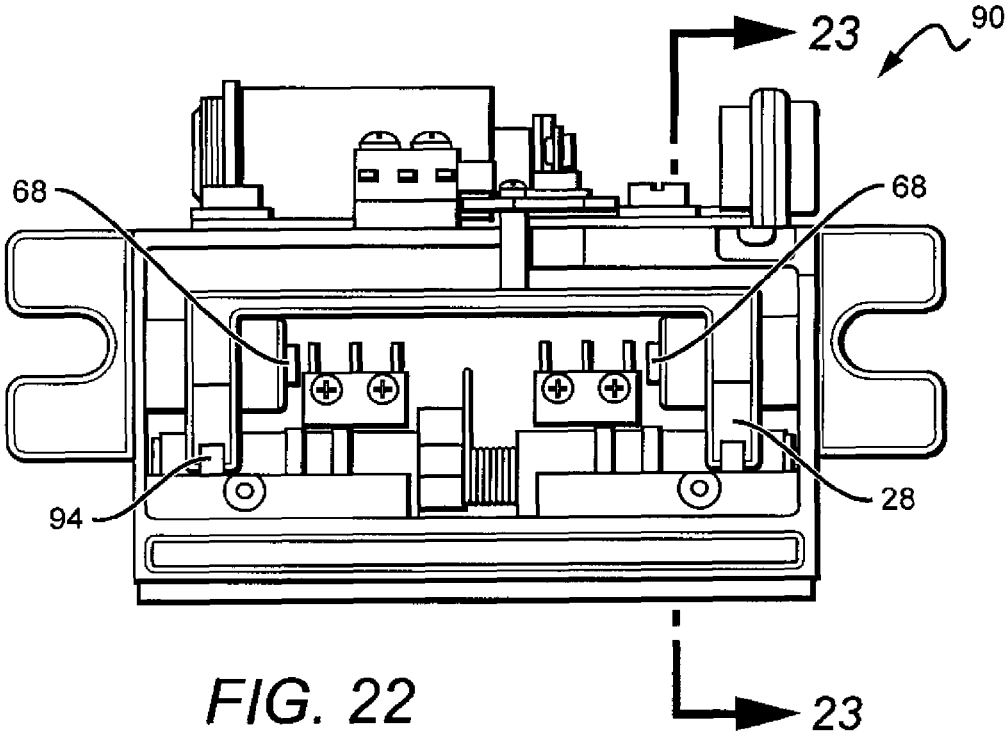
FIG. 22 is a front view of an electric strike according to the present invention having pre-load release features.
Figure 23:
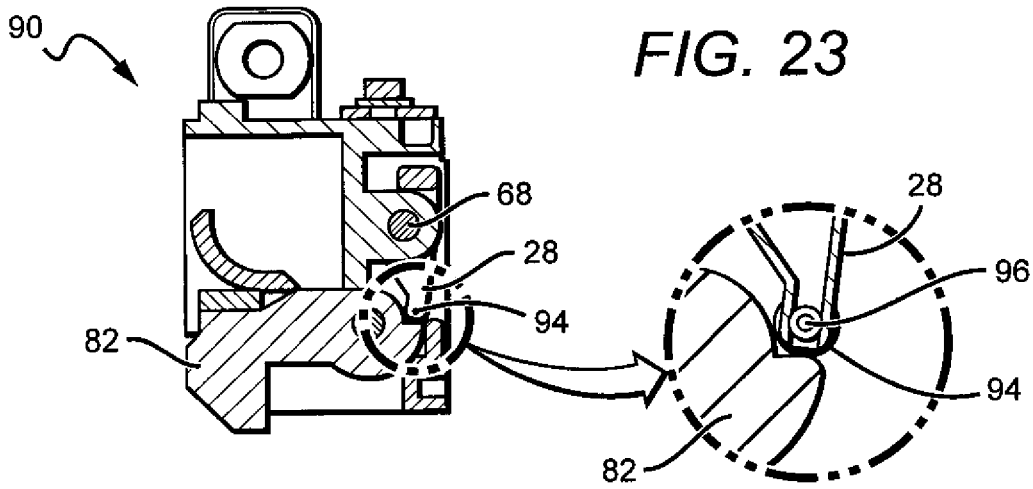
FIG. 23 is a side sectional view of the electric strike in FIG. 22.

To reduce pre-loading hang-up, different embodiments of the strikes according to the present invention can comprise features to allow the blocking element to more easily move to the unblocking position. Referring now to FIGS. 22 and 23 and electric strike 90 is shown having many of the same elements as electric strike 10 described above and shown in the previous figures. For the same or similar elements the same reference numerals are used in the description of strike (and other embodiment below) as were used in the description of strike 10. The strike 90 comprises a blocking element 28 that rotates around retaining pins 68 between a blocking position where it blocks rotation of the keeper 82, or an unblocking position where it allows rotation of the keeper 82.

The blocking element 28 has surfaces that contact the keeper when in the blocking position, and in this embodiment each of the surfaces has a roller 94 mounted at its end by an axel pin 96. The roller 94 contacts the keeper 82 and when the blocking element 28 is moved from the blocking to unblocking position, the roller 94 rolls along the contact surface with the keeper 82. This rolling action allows the blocking element 28 to move to the unblocking position while experiencing reduced friction with the surface of the keeper 82. This in turn allows the blocking element 28 to move positions more easily, even when under pre-load. It is understood that many other elements can be included to reduce friction between the blocking element 28 and the keeper 82. These can include but are not limited to bearings or layers of non-stick materials such as commercially known Teflon. It is also understood that these friction reducing structure and materials can also be included on the keeper or both the blocking element and the keeper.

Figure 24:
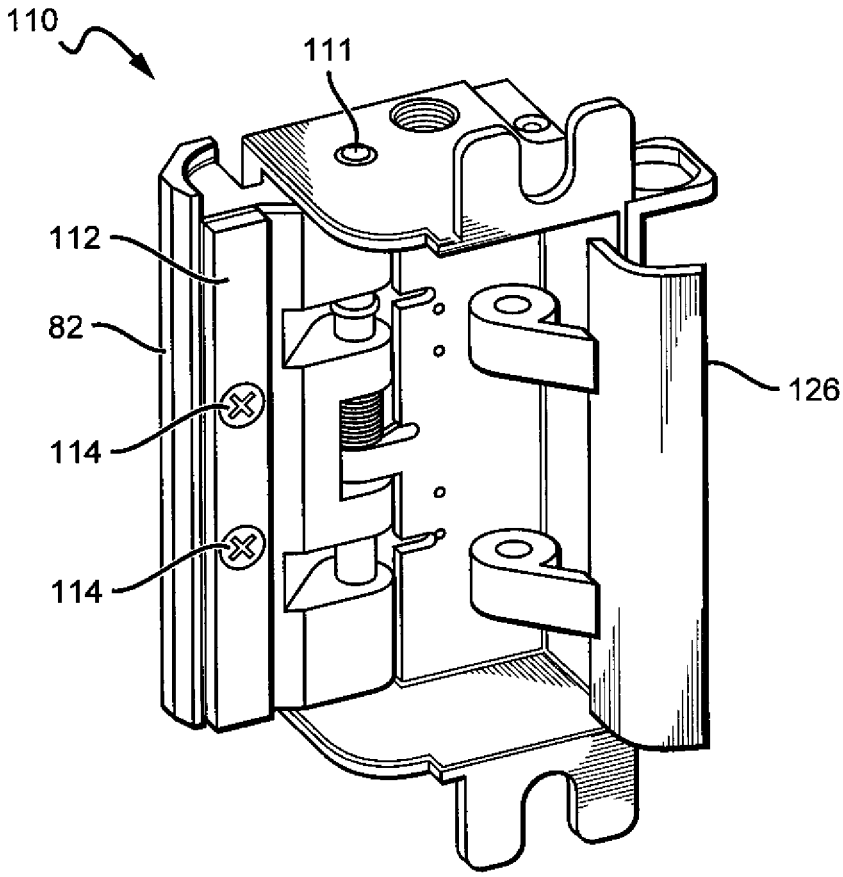
FIG. 24 is a perspective view of another embodiment of an electric strike according to the present invention having a keeper adjust plate.
Figure 25:
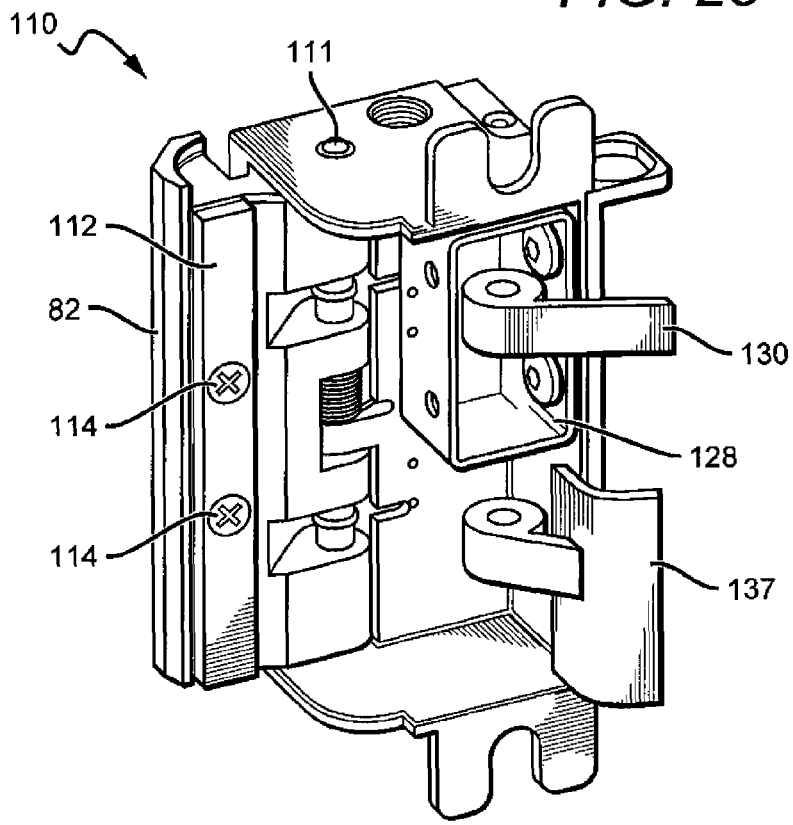
FIG. 25 is a perspective view of another embodiment of an electric strike according to the present invention having a keeper adjust plate.

The strikes according to the present invention can also provide for certain adjustment features to compensate for variances in different door and lock arrangements. FIGS. 24 and 25 show another embodiment of a strike 110 having a keeper 82 mounted to the housing 12 by retaining pins 111. The keeper 82 can also have an adjust plate 112 mounted to its inside surface to adjust for the size of the bolt opening in the strike 110. When the size of the opening needs to be increased to adjust for the location of the strike, the adjust plate 112 can be removed by removing adjust screws 114. Similarly, if the size of the keeper opening needs to be reduced the adjust plate 112 can be added. It is understood that different sized adjust plates can be available to provide different adjustments to the size of the keeper opening, and that adjust plates can be mounted in different locations in the keeper opening.

The strikes according to the present invention can also comprise mechanisms to monitor the state of the strike. Referring now to FIG. 20, the strike 10 comprises a tray switch 120 that can be arranged to monitor the condition of many different features and mechanisms including but not limited to the state of the solenoid (i.e. energized or not, or plunger 52 extended or not), the location of the tray 22 and/or the location/state of the lever 24. It can also comprise first and second keeper switches 122, 124 that can monitor the location/state of the keeper 82 or the blocking element 28. For example, one of the first and second keeper switches 122, 124 can monitor whether the keeper 82 is blocked or free to rotate, while the other of the first and second keeper switches 122, 124 can monitor the location of the blocking element 28. These switches can be connected to electrical conductors (e.g. wires) such that the state of the switches can be reported in the form of an electrical signal. This allows the status of the electric strike to be monitored by remote monitoring systems.

Referring now to FIGS. 24 and 25, the strike 110 can also comprise paddles to monitor whether a latch bolt is inserted in the electric strike opening. For the electric strike 110 in FIG. 24, a full length paddle 126 is included that covers most of the electric strike opening such that when a latch bolt is inserted into the opening the paddle 126 is actuated. This actuation can trip a switch that produces a signal evidencing that a latch bolt is now in the strike opening. For the electric strike 110 in FIG. 25 the strike opening is divided into two opening by the dead bolt retainer 128 that are arranged to hold a dead bolt. The strike also comprises a dead bolt paddle 130 in the dead bolt retainer 128, and a half paddle 132 covering the remainder of the strike opening. The dead bolt paddle 130 is actuated when a dead bolt is inserted in the dead bolt retainer 128, and the half paddle is actuated when a latch bolt is inserted in the other section of the strike opening. This allows for the strike 110 in FIG. 25 to operate with a lock having a dead bolt and a latch bolt and for the strike to monitor whether either or both have been inserted in the strike opening.

Figure 26:
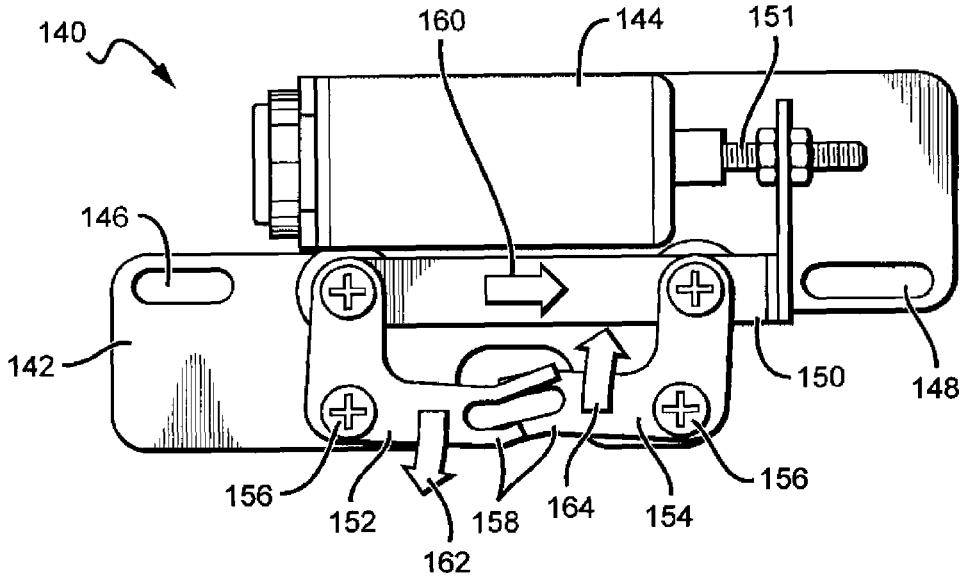
FIG. 26 is a top view of another embodiment of a solenoid and tray arrangement that can be used in another embodiment of an electric strike according to the present invention.

The strike 10 is described above with reference to mode position tray 22, solenoid lever 24, and solenoid 26 imparting movement on the finger 78, which in turn causes rotation of the blocking element 28. As discussed above, different arrangements can be utilized to impart this movement on the finger 78 and rotation of the blocking element 28. FIG. 26 shows another embodiment of an internal mechanism 140 that can impart movement on a blocking element finger. The mechanism 140 comprises a mode position tray 142 with a solenoid 144 mounted to the tray 142. First and second tray slots 146, 148 are included in the tray 142 to allow the tray to be slid between two positions within the strike in much the same way as tray slots 32 described above. The mechanism 140 further comprises a solenoid bar 150 attached to the solenoid plunger, and first and second opposing levers 152, 154 rotatably mounted to the tray 142 about lever screws 156.

When the solenoid plunger 151 moves between the retracted and extended positions it laterally moves the solenoid bar 150. This in turn causes the first and second levers to rotate about their respective one of the screws 156. The forked ends 158 of the levers 154, 156 form a slot for the blocking element finger, the rotation of the first and second levers causes the forked ends 158 of the levers 154, 156 to move in opposing directions. For example, if the bar 150 moves in direction of arrow 160, the first lever 152 moves in direction of arrow 162 and the second lever 154 moves in direction of arrow 164. This action causes a change in the shape of the slot formed by the forked ends 158, which in turn causes movement of the blocking element finger. This in turn causes rotation of the blocking element between blocking and unblocking of the keeper depending on whether in the fail-safe or fail-secure mode. This is only one of the many different alternative mechanisms that can impart the desired movement of the finger and rotation of the blocking element.

Although the present invention has been described in detail with reference to certain preferred configurations thereof, other versions are possible. Therefore, the spirit and scope of the invention should not be limited to the versions described above.

We claim:

1. An electric strike, comprising:

a housing;

a keeper movably mounted to said housing;

an actuator mounted to said housing to switch operation of said strike between open and locked modes, said actuator providing lateral motion;

a blocking element mounted to said housing and cooperating with said actuator, wherein said actuator lateral motion causes rotational movement in said blocking element to switch between said open and locked modes; and a lever movably mounted to said housing, said lever moving in response to said actuator lateral movement and causing said blocking member rotational movement;

wherein said lateral motion and the axis of said rotational movement are substantially parallel;

wherein said lever has a slot and said blocking element comprising a finger in said slot, said lever movement causing said finger to move in said slot.

2. The electric strike of claim 1, wherein movement of said keeper is blocked by said blocking element when in said locked mode.

3. The electric strike of claim 1, operable in fail-safe and fail-secure modes.

4. The electric strike of claim 1, wherein said actuator is movable between fail-safe and fail-secure operation locations.

5. The electric strike of claim 1, wherein said actuator is manually slidable between a first fail-safe mode location and a second fail-secure mode location.

6. The electric strike of claim 1, further comprising a movable tray, said actuator mounted to said movable tray.

7. The electric strike of claim 1, further comprising a lever movably mounted to said housing, said lever moving in response to said actuator lateral movement and causing said blocking member rotational movement.

8. The electric strike of claim 1, wherein said blocking element is rotationally mounted to said housing at more than one point.

9. The electric strike of claim 1, wherein said blocking element is rotationally mounted to said housing at two opposing points.

10. The electric strike of claim 1, wherein said blocking element has a plurality of blocking surfaces that contact said keeper when said strike is in said locked mode.

11. The electric strike of claim 1, wherein said blocking element has two blocking surfaces that contact said keeper when said strike is in said locked mode.

12. The electric strike of claim 1, having a switch to monitor the condition of one of its internal components.

13. The electric strike of claim 1, comprising one or more blocking surfaces that contact said keeper when said strike is in said unlock mode, one or more of said blocking surfaces having a mechanism to reduce friction with said keeper.

14. The electric strike of claim 1, further comprising a bolt opening and adjustment plates in said bolt opening.

15. A dual mode electric strike, comprising:

a housing;

a keeper movably mounted to said housing;

an actuator mounted to said housing and cooperating with a blocking element, said actuator providing motion;

a solenoid with a plunger mounted to said housing, said plunger moving laterally upon actuation of said solenoid; and a lever that moves in response to said lateral movement of said plunger;

wherein said blocking element is rotatably mounted to said housing at a plurality of rotation mounting points, said blocking element rotationally movable between a locked and unlocked position, said blocking element comprising a plurality of blocking surfaces to block movement of said keeper when in a locked rotational position;

wherein said actuator motion and said blocking element rotational movement are substantially parallel;

wherein said lever has a slot and said blocking element comprising a finger in said slot, said lever movement causing said finger to move in said slot, said movement in said slot causing rotation of said blocking element.

16. The electric strike of claim 15, wherein said lateral movement of said plunger causes rotational movement of said blocking element.

17. The electric strike of claim 15, operable in fail-safe and fail-secure modes.

18. The electric strike of claim 15, wherein said solenoid is movable between fail-safe and fail-secure operation locations.

19. The electric strike of claim 15, wherein said solenoid is manually slidable between a first fail-safe mode location and a second fail-secure mode location.

20. The electric strike of claim 15, wherein said blocking element is rotationally mounted to said housing at two opposing points.

21. The electric strike of claim 15, wherein said blocking element has two blocking surfaces that contact said keeper when said strike is in said locked mode.

22. The electric strike of claim 15, further comprising a housing window to allow manual movement of said solenoid between fail-safe and fail-secure operation positions.

* * * * *